US011486174B2

(12) United States Patent
Tanino et al.

(10) Patent No.: US 11,486,174 B2
(45) Date of Patent: Nov. 1, 2022

(54) VEHICULAR DOOR LOCK DEVICE

(71) Applicant: AISIN CORPORATION, Kariya (JP)

(72) Inventors: Yasuaki Tanino, Kariya (JP); Yasuhiko Sono, Kariya (JP); Takumi Hayashi, Kariya (JP)

(73) Assignee: AISIN CORPORATION, Aichi (JP)

( * ) Notice: Subject to any disclaimer, the term of this patent is extended or adjusted under 35 U.S.C. 154(b) by 155 days.

(21) Appl. No.: 17/104,832

(22) Filed: Nov. 25, 2020

(65) Prior Publication Data

US 2021/0164274 A1 Jun. 3, 2021

(30) Foreign Application Priority Data

Nov. 29, 2019 (JP) ..... JP2019-217020

(51) Int. Cl.

| | |
|---|---|
| ***E05B 85/26*** | (2014.01) |
| ***E05B 81/06*** | (2014.01) |
| ***E05B 81/16*** | (2014.01) |
| ***E05B 81/34*** | (2014.01) |

(52) U.S. Cl.

CPC ..... *E05B 85/26* (2013.01); *E05B 81/06* (2013.01); *E05B 81/16* (2013.01); *E05B 81/34* (2013.01); *E05Y 2201/702* (2013.01)

(58) Field of Classification Search

CPC ..... E05B 85/20; E05B 85/24; E05B 85/243; E05B 85/26; E05B 81/06; E05B 81/16; E05B 81/34; E05B 81/36; E05B 81/42; E05B 81/90; Y10T 292/1047; Y10T 292/1082; Y10S 292/23

See application file for complete search history.

(56) References Cited

U.S. PATENT DOCUMENTS

| | | | | |
|---|---|---|---|---|
| 9,435,145 | B2 * | 9/2016 | Lujan | E05B 81/14 |
| 9,551,172 | B2 | 1/2017 | Barmscheidt et al. | |
| 10,808,435 | B2 * | 10/2020 | Estrada | E05B 81/90 |
| 2003/0116977 | A1 * | 6/2003 | Erices | E05B 81/16 292/201 |

FOREIGN PATENT DOCUMENTS

| | | | | |
|---|---|---|---|---|
| EP | 1320652 | B1 * | 11/2005 | E05B 77/12 |
| GB | 2478620 | A * | 9/2011 | E05B 79/10 |
| JP | 2015513624 | A | 5/2015 | |

* cited by examiner

*Primary Examiner* — Christine M Mills
*Assistant Examiner* — Christopher F Callahan
(74) *Attorney, Agent, or Firm* — Buchanan Ingersoll & Rooney PC

(57) ABSTRACT

A vehicular door lock device includes a rotary member being movable between a releasing position and an unlocking correspondent position by rotation of an electric motor and being elastically urged to a neutral position, a release lever switching a latch mechanism to an unlatched state by rotation of the rotary member from the neutral position to the releasing position, an active lever switching the vehicular door lock device to an unlocked state by rotational movement of the rotary member from the neutral position to the unlocking correspondent position and switching the vehicular door lock device to a locked state by rotational movement of the rotary member to a locking correspondent position, and a block lever blocking rotational movement of the rotary member from the locking correspondent position to the releasing position when switching from the unlocked state to the locked state is made.

3 Claims, 8 Drawing Sheets

VEHICULAR DOOR LOCK DEVICE

CROSS REFERENCE TO RELATED APPLICATIONS

This application is based on and claims priority under 35 U.S.C. § 119 to Japanese Patent Application 2019-217020, filed on Nov. 29, 2019, the entire content of which is incorporated herein by reference.

TECHNICAL FIELD

This disclosure generally relates to a vehicular door lock device.

BACKGROUND DISCUSSION

Some vehicular door lock devices include an electric driving means for opening a vehicle door by an electrical operation (such as a driving force of an electric motor). JP2015-513624A (Reference 1) discloses a vehicular door lock device including a rotary member rotating by rotational power of an electric motor and a trigger lever operating by rotation of the rotary member, and performing a normal operation of electrically opening a vehicle door by actuating the trigger lever. When a vehicle door is opened by an electrical operation in the vehicular door lock device, a lock lever is always held at a locking position. Further, when switching from the normal operation of opening a vehicle door by the electrical operation to an emergency operation of opening a vehicle door by a mechanical operation (such as a manual operation of a door handle) is made, the rotary member rotates in a direction opposite to a rotation direction in the normal operation, and the lock lever moves from a locking position to a lock releasing position. Consequently, the vehicle door can be opened by the mechanical operation.

When switching is made between three states being a locked state (a state in which a vehicle door cannot be opened by a mechanical operation), an unlocked state (a state in which a vehicle door can be opened by a mechanical operation), and an unlatched state (a state in which a vehicle door is opened by an electrical operation; may also be referred to as a "released state") by switching between forward and reverse rotation directions of one electric motor, it may be difficult to suitably switch between the states. For example, in a case of setting an unlocking correspondent position (a position at which the vehicular door lock device is switched from the locked state to the unlocked state), a locking correspondent position (a position at which the vehicular door lock device is switched from the unlocked state to the locked state), and a releasing position (a position at which the vehicular door lock device is switched to the unlatched state and a vehicle door can be opened) to a rotary member rotation of which is driven by an electric motor, and setting the locking correspondent position between the unlocking correspondent position and the releasing position, when switching from the unlocked state to the locked state is made, the rotary member rotates from the unlocking correspondent position toward the locking correspondent position. However, even when the rotary member is to be stopped at the locking correspondent position, there is a possibility of overshooting the locking correspondent position due to inertia of a rotation shaft of the motor and the rotary member. Then, when the rotary member overshoots the locking correspondent position and reaches the releasing position, the vehicular door lock device is switched to the unlatched state. Thus, it is difficult to suitably switch between the three states by switching between the forward and reverse directions of rotation of the electric motor.

A need thus exists for a vehicular door lock device which is not susceptible to the drawback mentioned above.

SUMMARY

A vehicular door lock device according to this disclosure includes a mechanical opening mechanism (open link), an electric motor, a rotary member, a first urging member (rotary member urging member), an active lever, a release lever, a block lever, and a second urging member (block lever urging member). The mechanical opening mechanism (open link) is configured to be rotatable between an open position and an unopen position, make a vehicle door openably and closably connected to a vehicle body openable when being actuated by a mechanical operation at the open position, and make the vehicle door unopenable when being actuated by a mechanical operation at the unopen position. The electric motor rotates in forward and reverse directions by being energized. The rotary member rotates between a first rotation position (unlocking correspondent position) and a second rotation position (unlatching correspondent position) by transfer of rotation of the electric motor. The first urging member (rotary member urging member) elastically urges the rotary member to a neutral position between the first rotation position (unlocking correspondent position) and the second rotation position (unlatching correspondent position). The active lever is rotatable between an unlocking position and a locking position, and is connected to the mechanical opening mechanism (open link) in such a way as to cause the mechanical opening mechanism (open link) to rotate from the unopen position to the open position when rotating from the locking position to the unlocking position and cause the mechanical opening mechanism (open link) to rotate from the open position to the unopen position when rotating from the unlocking position to the locking position. The release lever is configured to be rotatable between an initial position and an operating position and is configured to, by rotating from the initial position to the operating position, allow the vehicle door to open without actuation of the mechanical opening mechanism (open link). The block lever is configured to be movable between a retraction position out of a rotation path of the rotary member and a block position in a rotation path of the rotary member. The second urging member (block lever urging member) elastically urges the block lever in a direction toward the retraction position. The active lever engages with the rotary member in such a way as to rotate in a direction from the locking position toward the unlocking position when the rotary member rotates from the neutral position to the first rotation position (unlocking correspondent position) while the active lever is at the locking position and rotate in a direction from the unlocking position to the locking position when the rotary member rotates from the neutral position to a third rotation position (locking correspondent position) between the neutral position and the second rotation position (unlatching correspondent position) while the active lever is at the unlocking position. The release lever engages with the rotary member in such a way as to rotate from the initial position to the operating position at the second rotation position (unlatching correspondent position) when the rotary member rotates from the neutral position to the second rotation position (unlatching correspondent position). The block lever engages with the active lever in such a way as to move from the retraction position to the block position against an elastic urging force of the second urging member (block lever urging member) when the active lever rotates from the locking position to the unlocking position. The rotary member is configured in such a way as to cause rotation in a direction from the third rotation position (locking correspondent position) toward the second rotation position (unlatching correspondent position) to be blocked by engaging with the block lever at the third rotation position (locking correspondent position) when rotating in a direction from the neutral position toward the third rotation position (locking correspondent position) while the active lever is at the unlocking position.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
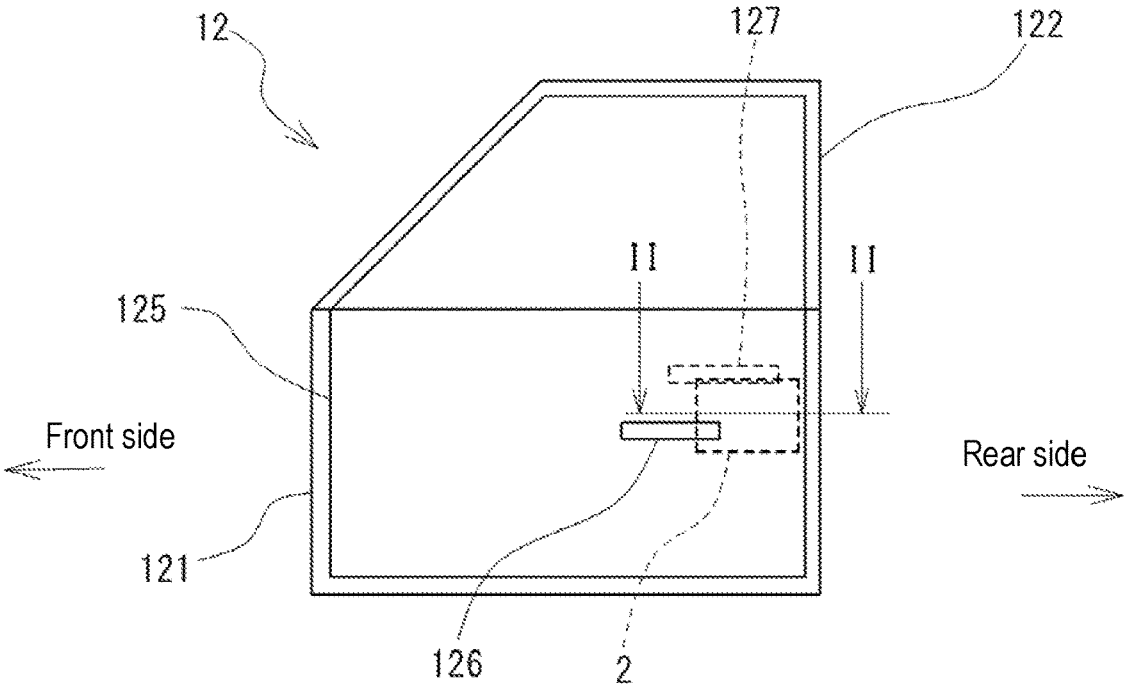
FIG. 1 is a schematic diagram illustrating a structure example of a vehicle door to which a vehicular door lock device according to an embodiment of this disclosure is applied.
Figure 2:
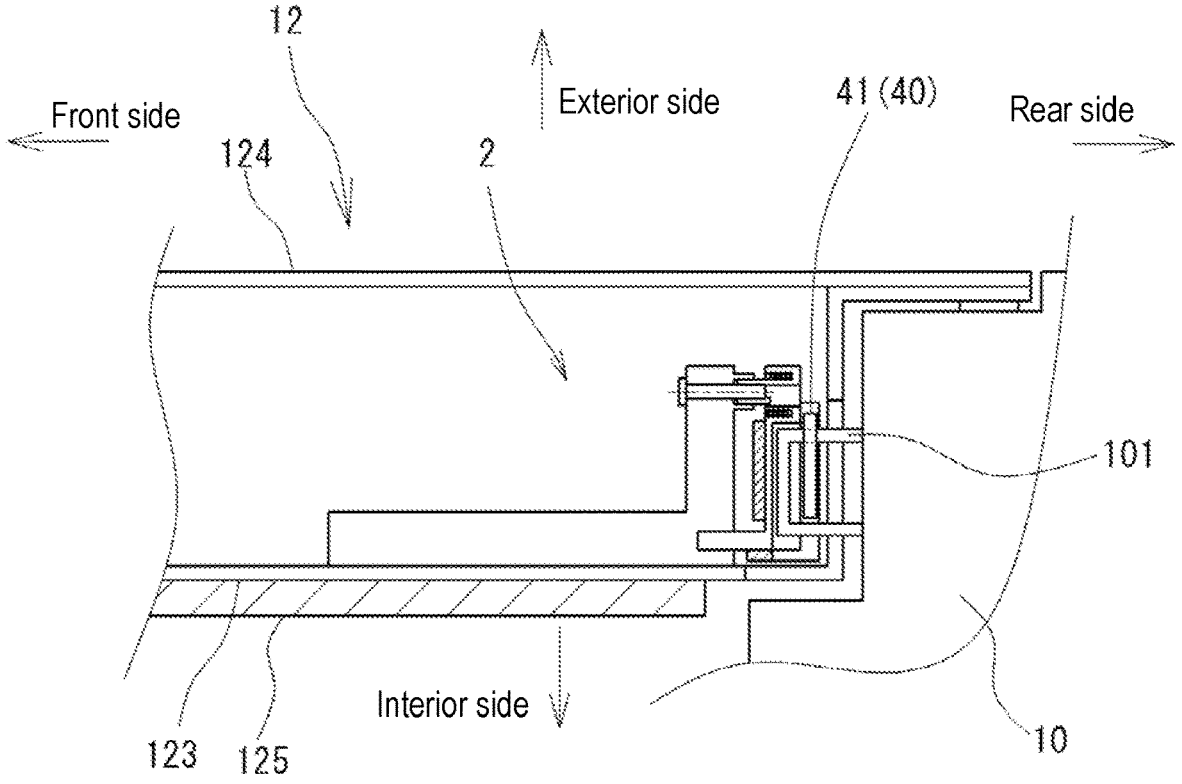
FIG. 2 is a cross-sectional view taken along a II-II line in FIG. 1.

A vehicular door lock device 2 according to an embodiment of this disclosure will be explained with reference to the attached drawings. For convenience of explanation, the vehicular door lock device 2 according to the embodiment of this disclosure may be shortened to "a door lock device 2." FIG. 1 is a side view of a vehicle door 12 to which the door lock device 2 is applied and is a diagram viewed from the interior side. FIG. 2 is a cross-sectional view of the neighborhood of the rear end of the vehicle door 12 to which the door lock device 2 is applied and is taken along a II-II line in FIG. 1.

The vehicle door 12 is rotatably connected to the vehicle body 10 and is configured to allow closure and opening by rotationally moving with respect to the vehicle body 10. The vehicle door 12 includes a door body part 121 constituting the lower part thereof and a door sash 122 provided in the upper part thereof. The door body part 121 includes an outer panel 124 constituting the outer side of the vehicle door 12, an inner panel 123 fixed to the interior side of the outer panel 124, and a resin trim 125 being fixed to the interior side of the inner panel 123 and constituting the inner side of the door body part 121. An outside door handle 127 and an inside door handle 126 are attached to the outer panel 124 and the trim 125, respectively, in such a way as to be rotatably movable with respect to the vehicle door 12. The structure of the vehicle door 12 is not particularly limited. The vehicle door 12 has only to be rotatably connected to the vehicle body 10 and be configured to allow closure and opening by rotationally moving with respect to the vehicle body 10.

As illustrated in FIG. 2, the door lock device 2 is placed in an interior space (that is, a space enclosed by the outer panel 124 and the inner panel 123) of the vehicle door 12, and part of the device is exposed to the outside at the rear end of the vehicle door 12. Then, the door lock device 2 is fixed to the inner panel 123 (that is, the vehicle door 12).

The door lock device 2 includes a latch mechanism 40 can be switched between a latched state and an unlatched state. The latched state refers to a state in which the vehicle door 12 is held unopenable with respect to the vehicle body 10 (may be hereinafter referred to as a "closed state"), and the unlatched state refers to a state in which the closed state of the vehicle door 12 can be released, that is, a state in which the vehicle door 12 can be opened. The latch mechanism 40 includes a latch 41 that can hold a striker 101 fixed to the vehicle body 10, a pole engageable with the latch 41, and a lift lever 42 linked to the pole. Then the latch mechanism 40 is configured to switch from a state (latched state) in which the latch 41 is engaged with the striker 101 and holds the striker 101 to a state (unlatched state) in which the engagement between the latch 41 and the striker 101 is released and the holding of the striker 101 can be released, by movement of the lift lever 42 from a non-releasing position to a releasing position. The structure of the latch mechanism 40 is not particularly limited, and a conventionally known structure can be applied. Essentially, the latch mechanism 40 has only to be configured to switch from the latched state to the unlatched state by movement of the lift lever 42 from the non-releasing position to the releasing position.

Further, the door lock device 2 is configured to allow switching between a locked state and an unlocked state. The locked state refers to a state in which the engagement between the latch 41 and the striker 101 cannot be released by a mechanical operation being a manual operation of the inside door handle 126 or the outside door handle 127 provided on the vehicle door 12, or an external manual operation, that is, a state in which the latch mechanism 40 cannot be switched from the latched state to the unlatched state (a state in which the vehicle door 12 is not opened). The unlocked state refers to a state in which the engagement between the latch 41 and the striker 101 can be released by a mechanical operation being a manual operation of the inside door handle 126 or the outside door handle 127, or an external manual operation, that is, a state in which the latch mechanism 40 can be switched from the latched state to the unlatched state (a state in which the vehicle door 12 can be opened).

The door lock device 2 is configured to allow switching from the locked state to the unlocked state and switching from the unlocked state to the locked state by a driving force of an electric motor 22 to be described later. Furthermore, the door lock device 2 is configured to allow switching from the latched state to the unlatched state of the latch mechanism 40 by the driving force of the electric motor 22.

Figure 3:
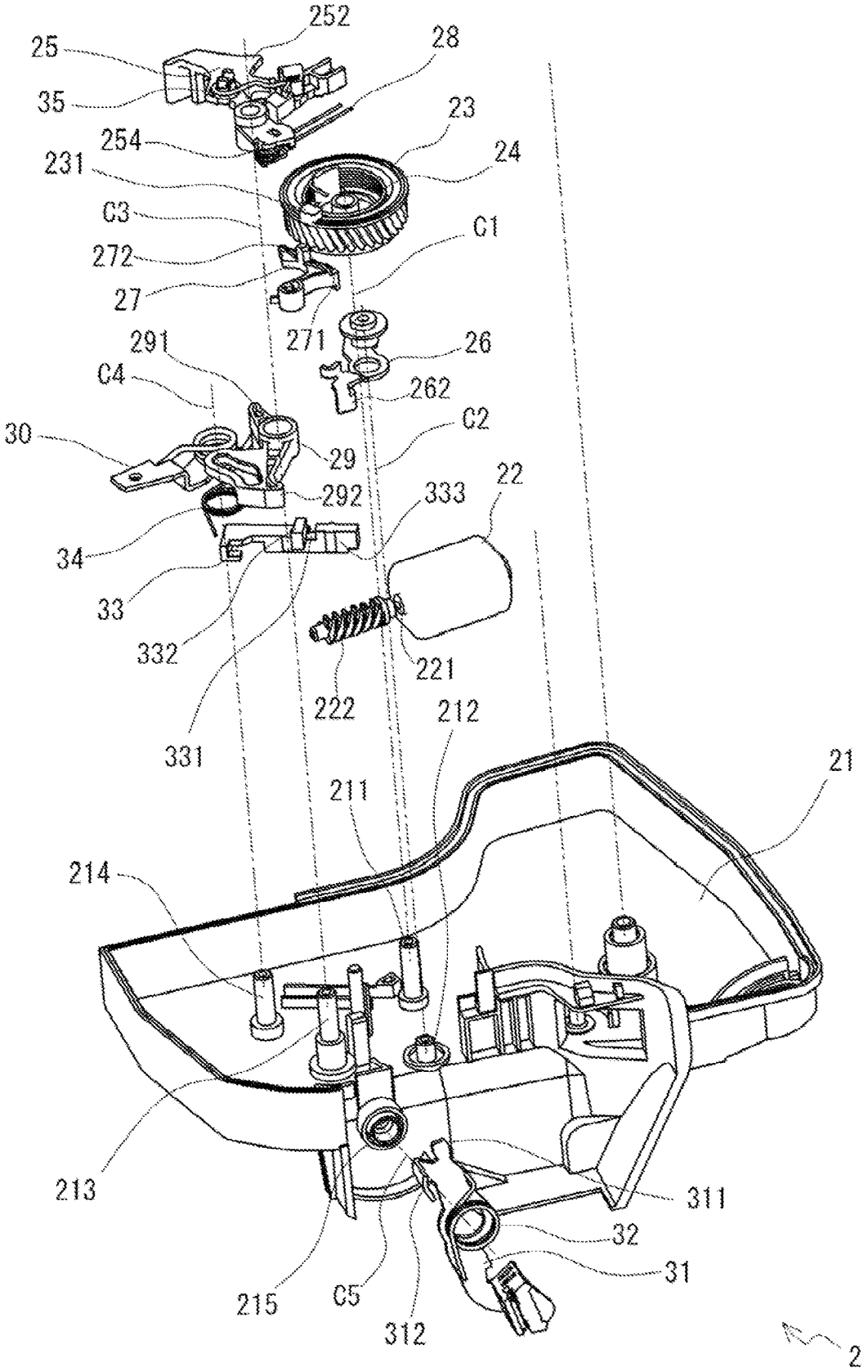
FIG. 3 is an exploded perspective view illustrating a structure example of the vehicular door lock device according to the embodiment of this disclosure.

FIG. 3 is an exploded perspective view illustrating a structure example of the door lock device 2. FIG. 4 to FIG. 9 are diagrams illustrating a structure example and an operation of the door lock device 2. For simplified illustration of a positional relation between members, some of lines are omitted in FIG. 4 to FIG. 9. The door lock device 2 includes a housing 21, the electric motor 22, a rotary member 23, a rotary member urging member 24 being an example of a first urging member, an active lever 25, a moderating spring 35, a block lever 33, a block lever urging member 34 being an example of a second urging member, a release lever 26, an inside lever 29, an inside open lever 30, an outside open lever 31, an outside open lever urging member 32, an open link 27 being an example of a mechanical opening mechanism, and the aforementioned latch mechanism 40.

The housing 21 is a member having a function as an enclosure of the door lock device 2. The housing 21 includes a first supporting part 211 to a fifth supporting part 215. The first supporting part 211 is configured to be able to rotatably support the rotary member 23. The second supporting part 212 is configured to be able to rotatably support the release lever 26. The third supporting part 213 is configured to be able to coaxially and rotatably support the active lever 25 and the inside lever 29. The fourth supporting part 214 is configured to be able to rotatably support the inside open lever 30. The fifth supporting part 215 is configured to be able to rotatably support the outside open lever 31.

A shaft hole is formed on each of the rotary member 23, the active lever 25, the release lever 26, the inside lever 29, the inside open lever 30, and the outside open lever 31. Then, by the first supporting part 211 to the fifth supporting part 215 being inserted in the shaft holes of the members, respectively, each member is rotatably supported with respect to the housing 21 with each of the supporting parts 211 to 215 at the center. While a structure in which columnar or cylindrical shafts, or the like are applied to the first supporting part 211 to the fifth supporting part 215 is illustrated in the present embodiment, specific structures of the first supporting part 211 to the fifth supporting part 215 are not limited. Each of the first supporting part 211 to the fifth supporting part 215 has only to be configured to rotatably support a predetermined member with respect to the housing 21.

Axes C1 to C4 (rotational center lines) of the rotary member 23, the release lever 26, the inside lever 29, and the inside open lever 30 are parallel to one another. Further, an axis C5 (rotational center line) of the outside open lever 31 is almost at right angles to the axes C1 to C4 (rotational center lines) of the release lever 26, the inside lever 29, and the inside open lever 30. Further, the open link 27 is rotatably supported with respect to the outside open lever 31. The electric motor 22 is fixed to the housing 21.

The electric motor 22 is a rotational driving power source of the rotary member 23 and can rotate in forward and reverse directions by being energized. A worm 222 is provided on a rotation shaft 221 of the electric motor 22, and the electric motor 22 rotationally drives the rotary member 23 through the worm 222. The electric motor 22 has only to be able to rotationally drive the rotary member 23 in both forward and reverse directions, and a specific structure thereof is not particularly limited. Various known motors may be applied to the electric motor 22.

The rotary member 23 is rotatably supported by the first supporting part 211 with respect to the housing 21 and is configured to rotate by rotational power transferred from the electric motor 22. In the present embodiment, a worm wheel is applied as the rotary member 23 and is engaged with the worm 222 provided on the rotation shaft 221 of the electric motor 22. The worm 222 on the electric motor 22 and the rotary member 23 (worm wheel) are configured to be reversely drivable. Specifically, the rotary member 23 may rotate by an urging force of the rotary member urging member 24 to be described later in a state in which the electric motor 22 is not energized (a state of not being driven by the electric motor 22).

Figure 4:
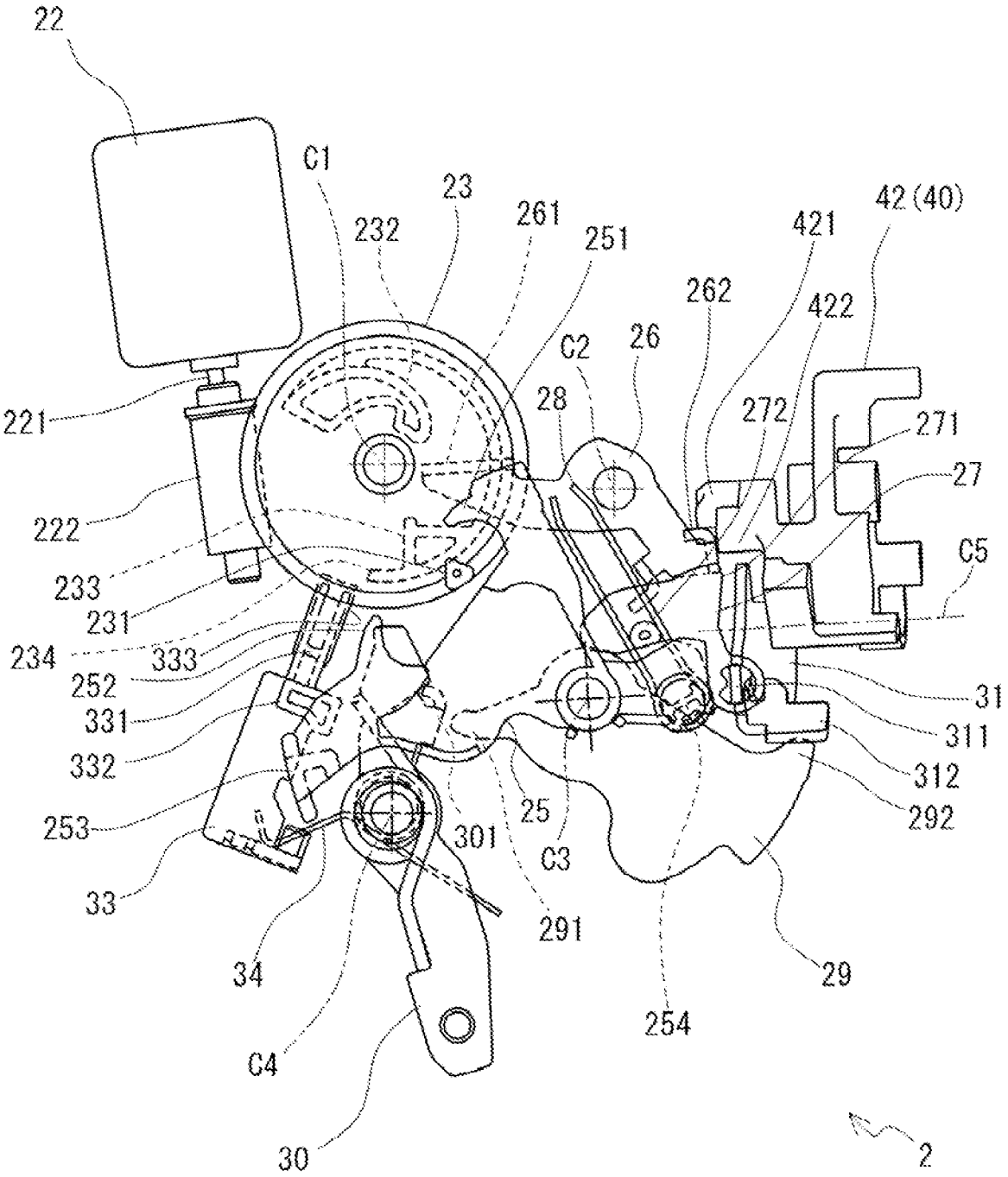
FIG. 4 is a diagram illustrating a structure example and an operation of the vehicular door lock device according to the embodiment of this disclosure and illustrates a locked state.
Figure 5:
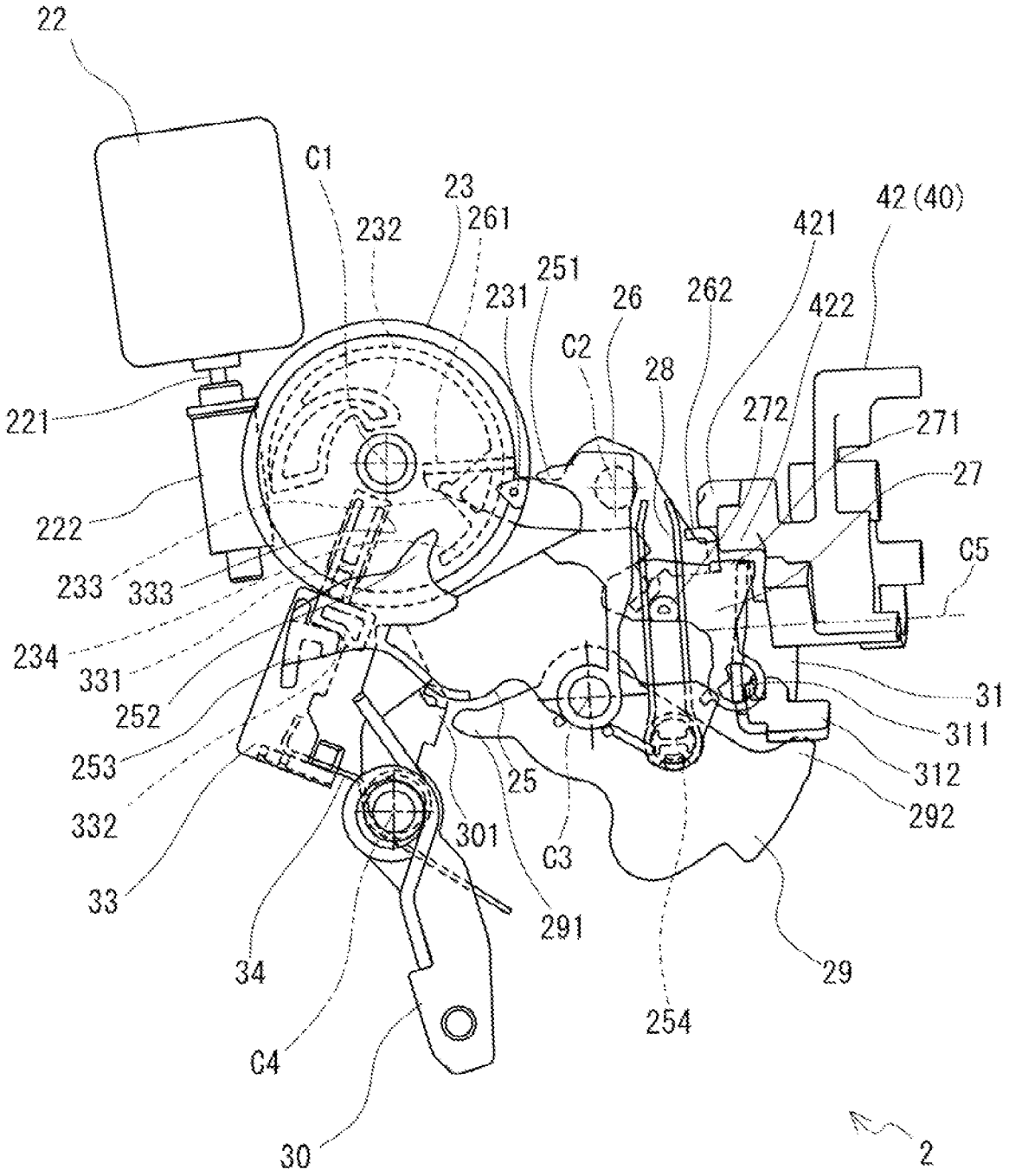
FIG. 5 is a diagram illustrating the structure example and the operation of the vehicular door lock device according to the embodiment of this disclosure and illustrates an unlocked state.
Figure 6:
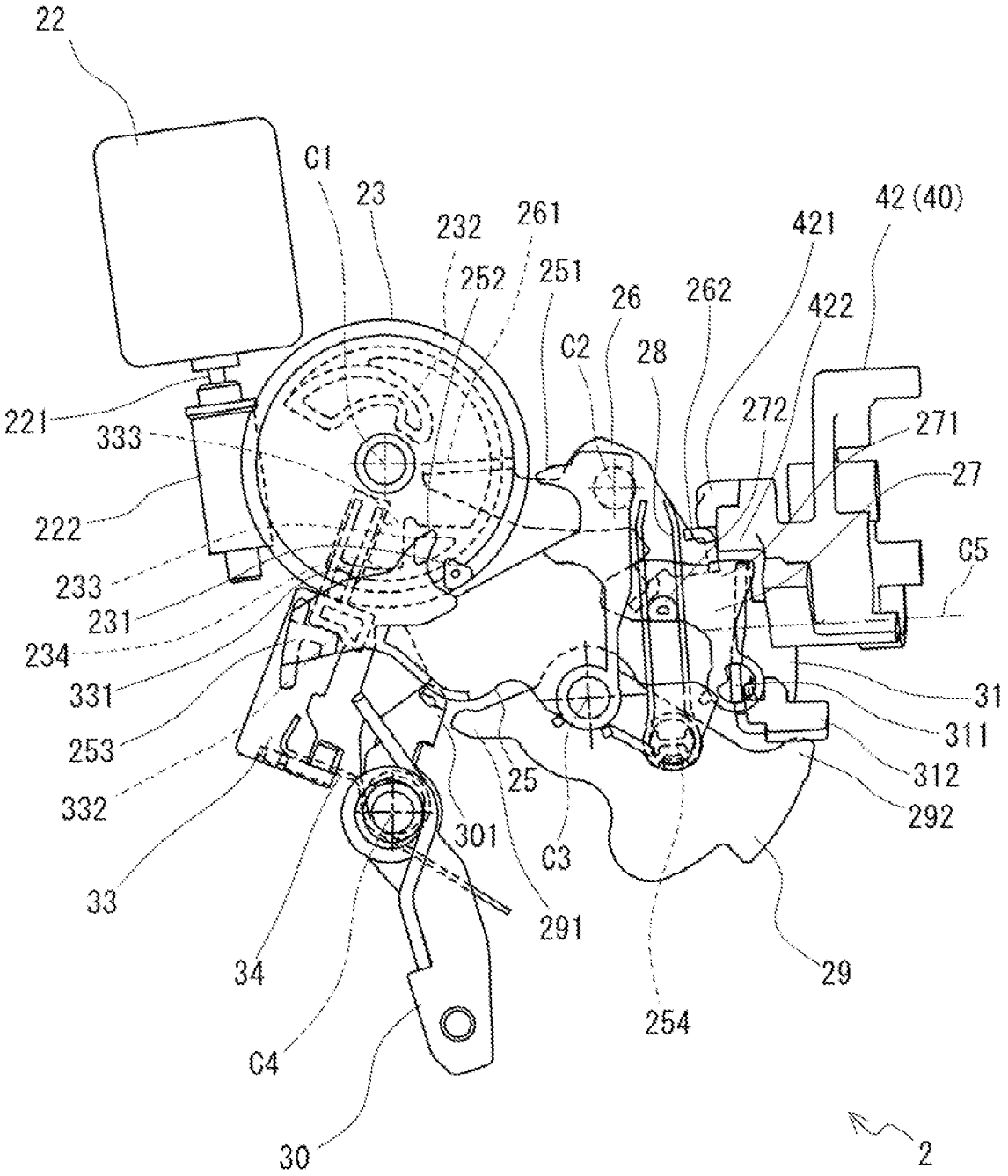
FIG. 6 is a diagram illustrating the structure example and the operation of the vehicular door lock device according to the embodiment of this disclosure and illustrates an operation of switching from the unlocked state to the locked state.
Figure 8:
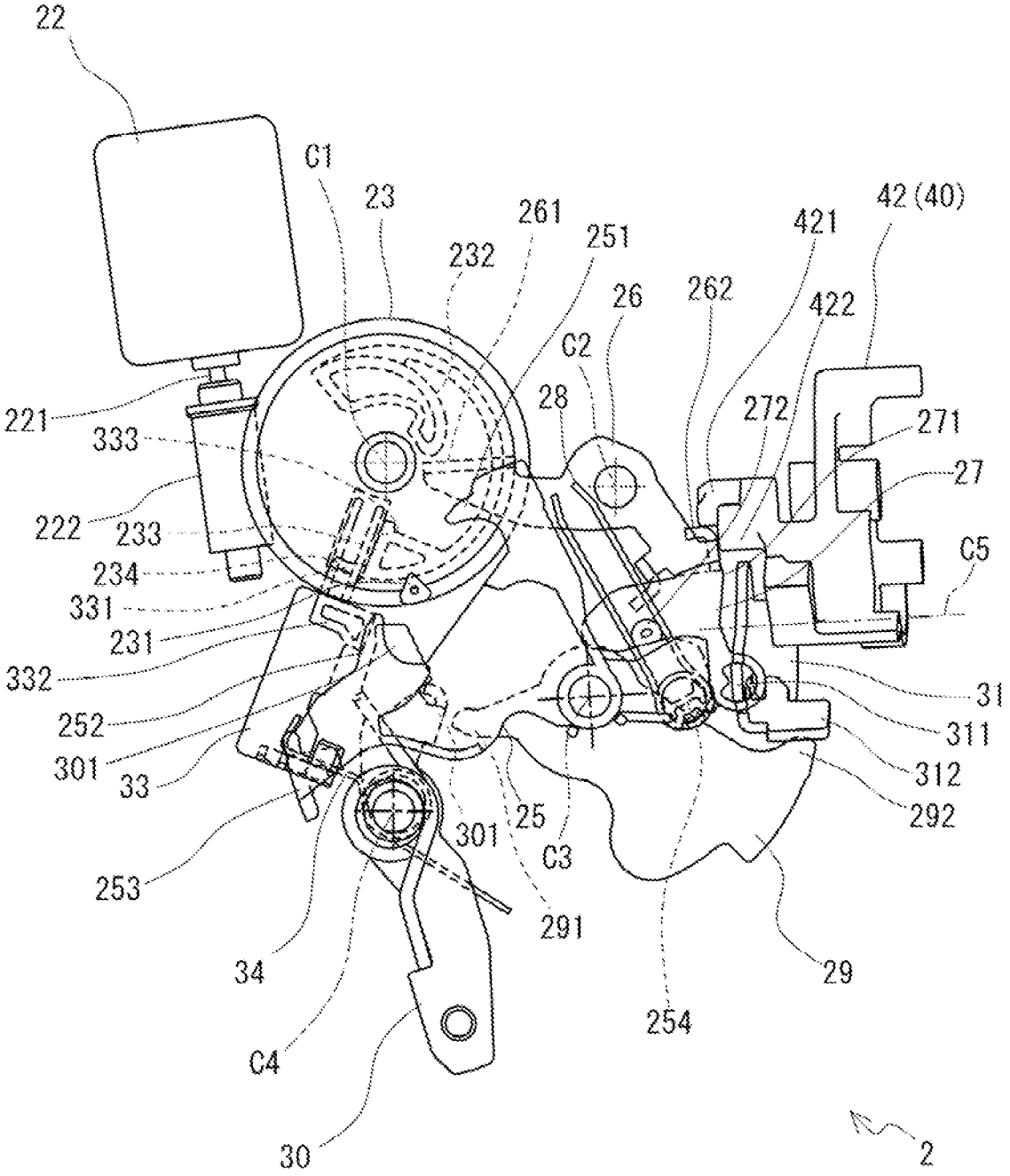
FIG. 8 is a diagram illustrating the structure example and the operation of the vehicular door lock device according to the embodiment of this disclosure and illustrates the operation of switching from the unlocked state to the locked state.
Figure 9:
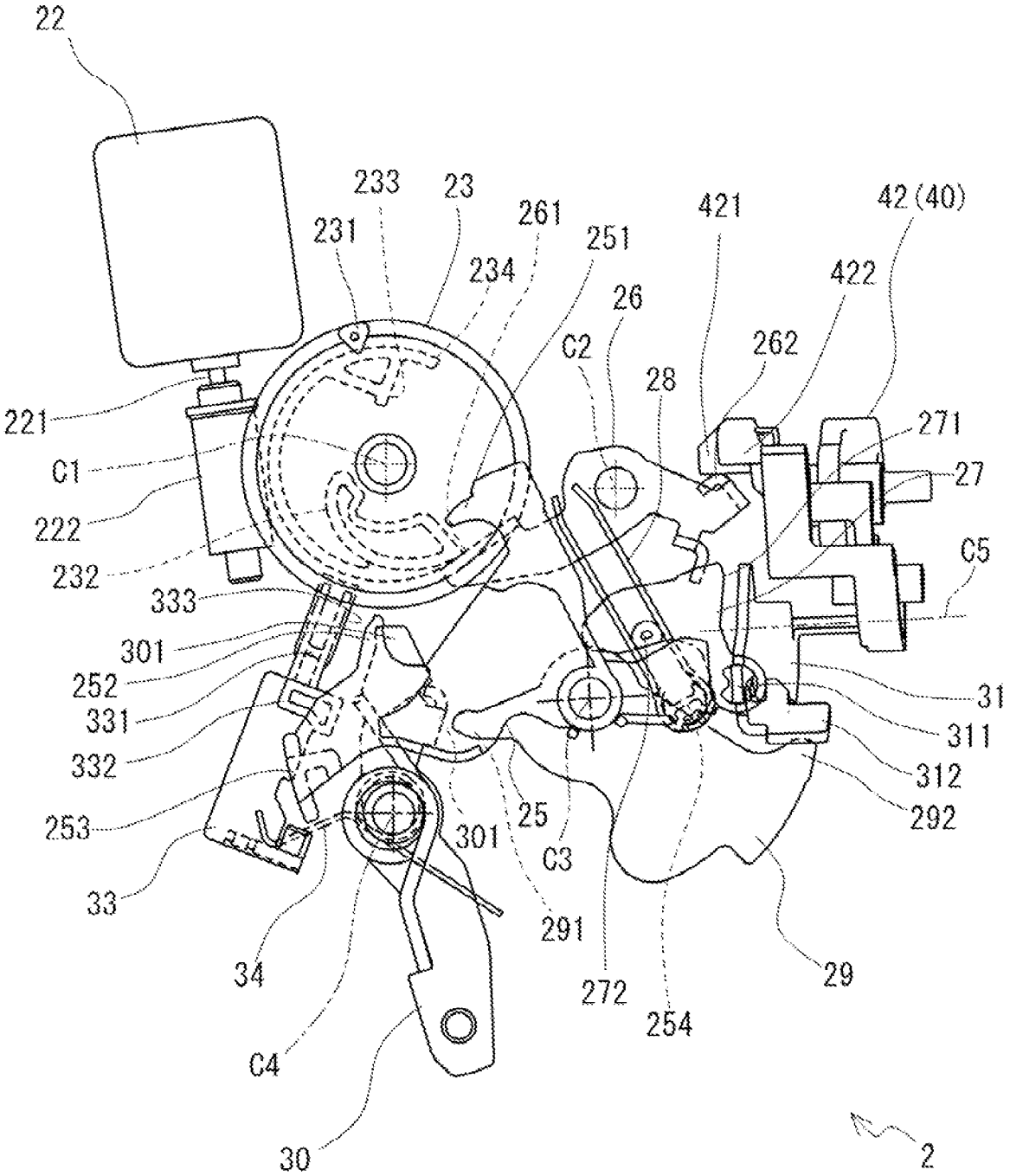
FIG. 9 is a diagram illustrating the structure example and the operation of the vehicular door lock device according to the embodiment of this disclosure and illustrates an operation of switching to an unlatched state.

The rotary member 23 is configured to be rotatable between a first rotation position and a second rotation position by transfer of rotation of the rotation shaft 221 of the electric motor 22. The first rotation position is a position for switching the door lock device 2 to the unlocked state. FIG. 5 illustrates a state in which the rotary member 23 is positioned at the first rotation position. The second rotation position is a position for switching the latch mechanism 40 in the door lock device 2 to the unlatched state. FIG. 9 illustrates a state in which the rotary member 23 is positioned at the second rotation position. For convenience of explanation, the first rotation position may be referred to as an "unlocking correspondent position," and the second rotation position may be referred to as a "releasing position." Further, the rotary member 23 is always elastically urged toward a neutral position between the unlocking correspondent position (first rotation position) and the releasing position (second rotation position) by the rotary member urging member 24. Accordingly, when the electric motor 22 is not operating (the electric motor 22 is not energized), the rotary member 23 is held at the neutral position by the urging force of the rotary member urging member 24. FIG. 4 and FIG. 6 illustrate states in which the rotary member 23 is positioned at the neutral position. Furthermore, a third rotation position is set between the neutral position and the releasing position. The third rotation position is a position for switching the door lock device 2 to the locked state. FIG. 8 illustrates a state in which the rotary member 23 is positioned at the third rotation position. For convenience of explanation, the third rotation position may be referred to as a "locking correspondent position."

Thus, the rotary member 23 can move to the unlocking correspondent position (first rotation position) by rotating in a predetermined direction (a counterclockwise direction in FIG. 4 to FIG. 9) from the neutral position and can move to the locking correspondent position (third rotation position) and the releasing position (second rotation position) by rotating in a direction opposite to the predetermined direction (a clockwise direction in FIG. 4 to FIG. 9) from the neutral position.

The rotary member 23 includes a first engaging part 231 to a fourth engaging part 234. The first engaging part 231 of the rotary member 23 is positioned at a position on one side of the rotary member 23 in the axis C1 direction (on the front of the page in FIG. 4 to FIG. 9) and outwardly apart from the axis C1 of the rotary member 23 in a radial direction (for example, in the neighborhood of the outer periphery of the rotary member 23). Then, the first engaging part 231 of the rotary member 23 includes a projection-shaped structure protruding toward one side of the rotary member 23 in the axis C1 direction (on the front of the page in FIG. 4 to FIG. 9) and is alternatively engageable with and disengageable from a first engaging part 251 or a second engaging part 252 of the active lever 25. Specifically, the first engaging part 231 of the rotary member 23 is configured to engage with the first engaging part 251 of the active lever 25 at a locking position and push the first engaging part 251 when the rotary member 23 rotationally moves from the neutral position to the unlocking correspondent position and is configured to engage with the second engaging part 252 of the active lever 25 at an unlocking position and push the second engaging part 252 when the rotary member 23 rotationally moves from the neutral position to the locking correspondent position.

The second engaging part 232 of the rotary member 23 is positioned at a position on a side opposite to the position of the first engaging part 231 with respect to the axis C1 direction of the rotary member 23 (on the back of the page in FIG. 4 to FIG. 9) and outwardly apart from the axis C1 of the rotary member 23 in a radial direction (for example, in the neighborhood of the outer periphery of the rotary member 23). Then, the second engaging part 232 of the rotary member 23 includes a projection-shaped structure protruding toward the other side of the rotary member 23 in the axis C1 direction (on the back of the page in FIG. 4 to FIG. 9) and is engageable with and disengageable from a first engaging part 261 of the release lever 26. Specifically, the second engaging part 232 of the rotary member 23 is configured to engage with the first engaging part 261 of the release lever 26 and push the first engaging part 261 of the release lever 26 at the releasing position when the rotary member 23 rotationally moves from the neutral position toward the releasing position.

The third engaging part 233 of the rotary member 23 is positioned at a position on the same side as the second engaging part 232 with respect to the axis C1 direction of the rotary member 23 (on the back of the page in FIG. 4 to FIG. 9) and outwardly apart from the axis C1 of the rotary member 23 in a radial direction (for example, in the neighborhood of the outer periphery of the rotary member 23). Then, the third engaging part 233 of the rotary member 23 is configured to be contactable with the block lever 33. Specifically, the third engaging part 233 of the rotary member 23 is formed in a wall shape extending in a radial direction of the rotary member 23 and is configured to come in contact with the block lever 33 positioned at a block position (to be described later) when the rotary member 23 rotationally moves from the neutral position toward the locking correspondent position. However, the third engaging part 233 of the rotary member 23 is configured not to engage with the release lever 26 regardless of the position of the rotary member 23.

The fourth engaging part 234 of the rotary member 23 is positioned at a position on the same side as the second engaging part 232 and the third engaging part 233 with respect to the axis C1 direction of the rotary member 23 and outwardly apart from the axis C1 of the rotary member 23 in a radial direction (for example, in the neighborhood of the outer periphery of the rotary member 23). Then, the fourth engaging part 234 of the rotary member 23 is configured to be engageable with and disengageable from a first engaging part 331 of the block lever 33 positioned at the block position. Specifically, the fourth engaging part 234 of the rotary member 23 includes a wall-shaped projection structure extending from the third engaging part 233 to one side of the circumferential direction of the rotary member 23 (the front side of the rotation direction when the rotary member 23 rotates from the unlocking correspondent position toward the locking correspondent position). Further, the fourth engaging part 234 of the rotary member 23 has an almost arc shape coaxial with the rotation center of the rotary member 23. Then, the fourth engaging part 234 of the rotary member 23 is configured to engage with the first engaging part 331 of the block lever 33 positioned at the block position by the rotary member 23 rotationally moving from the neutral position to the locking correspondent position.

The rotary member urging member 24 is an example of a first urging member and is configured to elastically urge the rotary member 23 toward the neutral position. For example, a helical torsion coil spring having an arm at each of the two ends is applicable to the rotary member urging member 24. In this case, a structure in which one arm is engaged with the rotary member 23 and the other arm is engaged with the housing 21 is applicable. The rotary member urging member 24 is not limited to a helical torsion coil spring as described above. The rotary member urging member 24 has only to have a structure permitting the rotary member 23 to rotationally move to the unlocking correspondent position, the locking correspondent position, and the releasing position by elastically urging the rotary member 23 toward the neutral position and elastically deforming itself.

Figure 7:
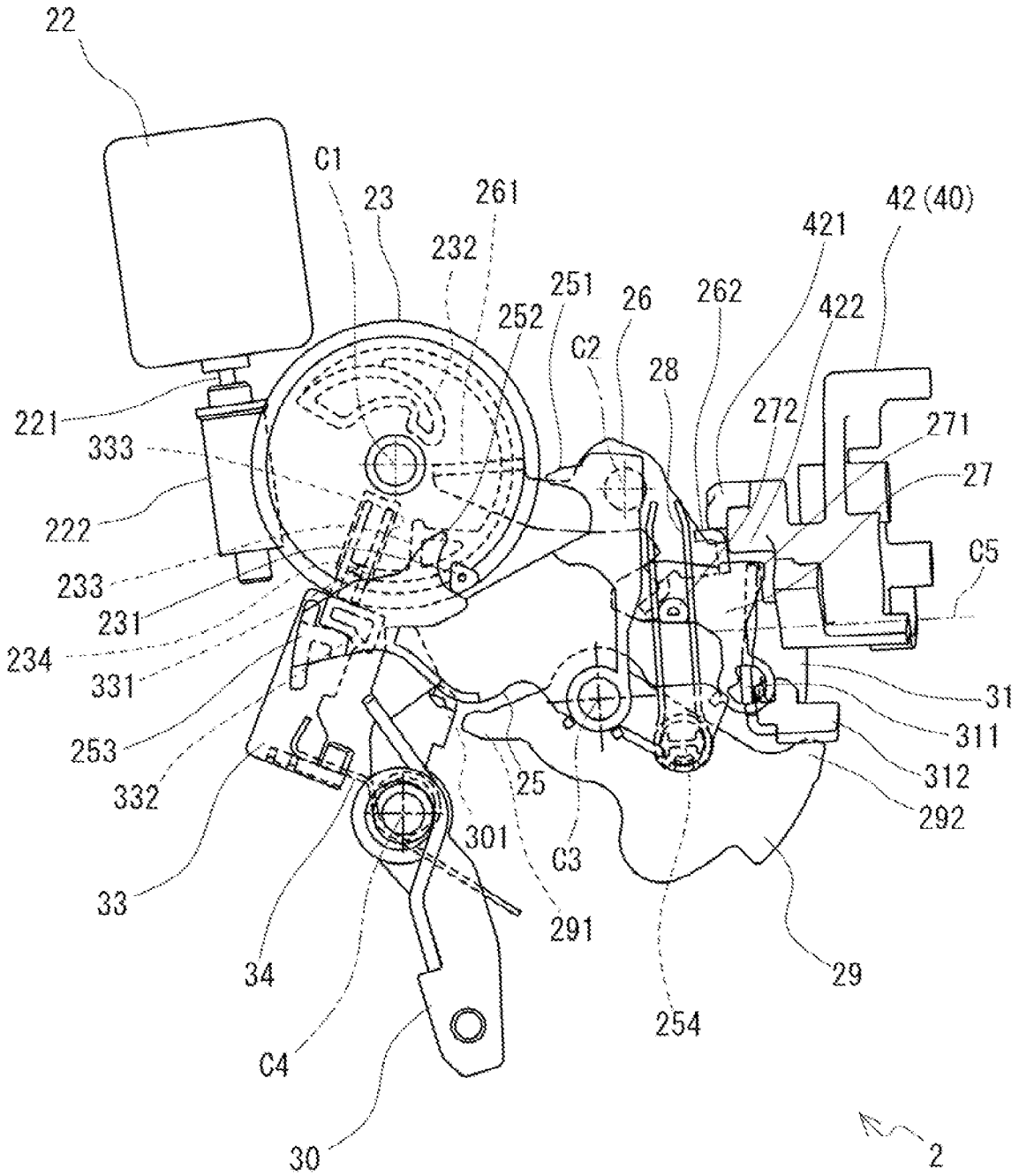
FIG. 7 is a diagram illustrating the structure example and the operation of the vehicular door lock device according to the embodiment of this disclosure and illustrates the operation of switching from the unlocked state to the locked state.

The active lever 25 is rotatably and movably supported by the third supporting part 213 with respect to the housing 21 and is configured to be movable between the locking position and the unlocking position by rotation. FIG. 4 and FIG. 8 illustrate states in which the active lever 25 is positioned at the locking position, and FIG. 5 to FIG. 7 illustrate states in which the active lever 25 is positioned at the unlocking position. The active lever 25 is elastically urged toward either one of the locking position and the unlocking position by the moderating spring 35. Specifically, the active lever 25 is elastically urged toward the locking position by the moderating spring 35 when being positioned closer to the locking position and is elastically urged toward the unlocking position by the moderating spring 35 when being positioned closer to the unlocking position. The structure of the moderating spring 35 is not particularly limited, and a conventionally known structure is applicable.

The active lever 25 includes the first engaging part 251 and the second engaging part 252 that are engageable with and disengageable from the first engaging part 231 of the rotary member 23. The first engaging part 251 of the active lever 25 is configured to be positioned on a movement path of the first engaging part 231 of the rotary member 23 and on the unlocking correspondent position side viewed from the first engaging part 231 of the rotary member 23 positioned at the neutral position in a state in which the active lever 25 is positioned at the locking position (see FIG. 4). The second engaging part 252 of the active lever 25 is configured to be positioned on the movement path of the first engaging part 231 of the rotary member 23 and on the locking correspondent position viewed from the first engaging part 231 of the rotary member 23 positioned at the neutral position in a state in which the active lever 25 is positioned at the unlocking position (see FIG. 5 and FIG. 6). Further, the first engaging part 251 and the second engaging part 252 of the active lever 25 are configured not to engage with the first engaging part 231 of the rotary member 23 when the rotary member 23 is positioned at the neutral position regardless of whether the active lever 25 is positioned at the locking position or the unlocking position (see FIG. 4 and FIG. 6). In other words, the first engaging part 231 of the rotary member 23 is configured to be positioned between the first engaging part 251 and the second engaging part 252 of the active lever 25 with respect to the circumferential direction of the rotary member 23 when the rotary member 23 is positioned at the neutral position.

Then, the first engaging part 251 of the active lever 25 engages with the first engaging part 231 of the rotary member 23 when the rotary member 23 moves from the neutral position to the unlocking correspondent position while the active lever 25 is positioned at the locking position. Then, the active lever 25 is pushed toward the unlocking position by the first engaging part 231 of the rotary member 23. Accordingly, when the rotary member 23 moves from the neutral position to the first rotation position (unlocking correspondent position), the active lever 25 moves (rotates) from the locking position toward the unlocking position. On the other hand, the second engaging part 252 of the active lever 25 engages with the first engaging part 231 of the rotary member 23 when the rotary member 23 moves from the neutral position to the locking correspondent position while the active lever 25 is positioned at the unlocking position. Then, the active lever 25 is pushed toward the locking position by the first engaging part 231 of the rotary member 23. Accordingly, when the rotary member 23 moves from the neutral position to the third rotation position (locking correspondent position), the active lever 25 moves (rotates) from the unlocking position toward the locking position.

In addition, the active lever 25 includes a third engaging part 253 engageable with and disengageable from a second engaging part 332 of the block lever 33. The third engaging part 253 of the active lever 25 is configured to hold the block lever 33 positioned at the block position at the block position when the active lever 25 is positioned at the unlocking position and permit movement of the block lever 33 from the block position to a retraction position when the active lever 25 is positioned at the locking position.

Further, the active lever 25 is linked with an unillustrated key cylinder provided on the vehicle door 12. For example, the active lever 25 is connected to the key cylinder through an unillustrated control lever. Then, the active lever 25 is configured to move from the locking position to the unlocking position or from the unlocking position to the locking position in response to an operation of the key cylinder.

The open link 27 is an example of a mechanical opening mechanism. The open link 27 is rotatably supported by a supporting part 311 of the outside open lever 31. Accordingly, the open link 27 is relatively rotatable with respect to the outside open lever 31 and is relatively rotatable with respect to the housing 21 as well as the outside open lever 31. Then, the open link 27 is movable (rotatable) between an open position and an unopen position by relatively rotating with respect to the outside open lever 31. Further, the open link 27 is movable between a non-operating position and an operating position along with the outside open lever 31. In other words, the open link 27 is configured to be movable from the non-operating position to the operating position at each of the open position and the unopen position.

The open link 27 includes a first engaging part 271 and a second engaging part 272. The first engaging part 271 of the open link 27 is configured to be engageable with and disengageable from a first engaging part 421 of the lift lever 42. Specifically, the first engaging part 271 of the open link 27 is configured to move the lift lever 42 from the non-releasing position to the releasing position by pushing the first engaging part 421 of the lift lever 42 of the latch mechanism 40 when moving from a non-operating position to an operating position along with the outside open lever 31 in a state in which the open link 27 is positioned at the open position. Thus, the open position of the open link 27 is a position where the lift lever 42 can be moved to the releasing position. Accordingly, when the open link 27 is moved from the non-operating position to the operating position by a mechanical operation being a manual operation of the outside door handle 127 or the inside door handle 126, or an external manual operation while the open link 27 is positioned at the open position, the engagement between the latch 41 and the striker 101 is released by movement of the lift lever 42 from the non-releasing position to the releasing position, and therefore the closed state of the vehicle door 12 is released. Thus, the vehicle door 12 can be opened.

On the other hand, the first engaging part 271 of the open link 27 is configured not to engage with the first engaging part 421 of the lift lever 42 (not to move the lift lever 42 from the non-releasing position to the releasing position) even when moving from the non-operating position to the operating position along with the outside open lever 31, in a state in which the open link 27 is positioned at the unopen position. Thus, the unopen position of the open link 27 is a position where the first engaging part 271 of the open link 27 is not engaged with the first engaging part 421 of the lift lever 42 (a position where the open link 27 does not allow the lift lever 42 to move to the releasing position). Accordingly, when the open link 27 is moved from the non-operating position to the operating position by a mechanical operation being a manual operation of the outside door handle 127 or the inside door handle 126, or an external manual operation while the open link 27 is positioned at the unopen position, the engagement between the latch 41 and the striker 101 cannot be released due to the lift lever 42 remaining at the non-releasing position, and therefore the closed state of the vehicle door 12 cannot be released, and the vehicle door 12 cannot be opened.

The second engaging part 272 of the open link 27 is a part engaged with the open link urging member 28. The open link urging member 28 is attached to an attaching part 254 of the active lever 25. Then, the open link urging member 28 elastically urges the open link 27 toward the unopen position when the active lever 25 is positioned at the locking position and elastically urges the open link 27 toward the open position when the active lever 25 is positioned at the unlocking position. For example, a helical torsion coil spring having an arm at each of the two ends is applicable to the open link urging member 28. The two arms of the open link urging member 28 are almost parallel and can be elastically deformed in such a way as to widen the space between the two arms. In this case, a projection-shaped structure protruding toward a direction (on the front of the page in FIG. 4 to FIG. 9) parallel to the axis of the open link 27 (a relative rotational center line with respect to the outside open lever 31) is applicable to the second engaging part 272 of the open link 27. Then, the second engaging part 272 of the open link 27 is positioned between the two arms of the open link urging member 28.

The release lever 26 is rotatably supported by the second supporting part 212 with respect to the housing 21 and is rotatably movable between an initial position and an operating position. FIG. 4 to FIG. 8 illustrate states in which the release lever 26 is positioned at the initial position, and FIG. 9 illustrates a state in which the release lever 26 is positioned at the operating position.

The release lever 26 includes a first engaging part 261 engageable with and disengageable from the second engaging part 232 of the rotary member 23 and a second engaging part 262 engageable with and disengageable from a second engaging part 422 of the lift lever 42. Then, the first engaging part 261 of the release lever 26 is configured to engage with the second engaging part 232 of the rotary member 23 at the releasing position when the rotary member 23 rotationally moves from the neutral position to the releasing position. When the first engaging part 261 of the release lever 26 is pushed by engaging with the second engaging part 232 of the rotary member 23, the release lever 26 moves from the initial position to the operating position. When the release lever 26 moves from the initial position to the operating position, the second engaging part 262 of the release lever 26 engages with the second engaging part 422 of the lift lever 42 of the latch mechanism 40 and moves the lift lever 42 from the non-releasing position to the releasing position. Thus, the release lever 26 is configured to allow the vehicle door 12 to open by moving (rotating) from the initial position to the operating position in conjunction with rotational movement of the rotary member 23 from the neutral position to the releasing position, consequently moving the lift lever 42 from the non-releasing position to the releasing position without actuating the open link 27, and releasing the engagement between the latch 41 and the striker 101.

The block lever 33 has a function of blocking the rotary member 23 from moving to the releasing position side past the locking correspondent position when the door lock device 2 is switched from the unlocked state to the locked state. The block lever 33 is formed nearly in a bar shape, is supported in such a way as to be linearly movable in a reciprocating manner with respect to the housing 21, and is configured to be movable between a retraction position and a block position. The moving direction of the block lever 33 is a direction intersecting a rotation direction (movement path) of the third engaging part 233 and the fourth engaging part 234 of the rotary member 23. FIG. 4 and FIG. 9 illustrate states in which the block lever 33 is positioned at the retraction position, and FIG. 5 to FIG. 7 illustrate states in which the block lever 33 is positioned at the block position. The retraction position is a position where rotation of the rotary member 23 is not blocked and is specifically a position outside the rotation path of the third engaging part 233 and the fourth engaging part 234 of the rotary member 23.

The block position is a position where the block lever 33 blocks the rotary member 23 from rotationally moving from the locking correspondent position to the releasing position by being in contact with the third engaging part 233 of the rotary member 23 and being engaged with the fourth engaging part 234 of the rotary member 23. Specifically, the block position is a position where at least part of the block lever 33 gets in the rotation paths of the third engaging part 233 and the fourth engaging part 234 of the rotary member 23, and is also a position where the side (a surface positioned on the front side of the rotation direction when the rotary member 23 rotates from the neutral position toward the locking correspondent position) of the third engaging part 233 of the rotary member 23 is in contact with the block lever 33 in a state in which the rotary member 23 is positioned at the locking correspondent position.

The block lever 33 includes the first engaging part 331 and the second engaging part 332. The first engaging part 331 of the block lever 33 is formed as a groove which the fourth engaging part 234 of the rotary member 23 is insertable in and removable from. Specifically, the groove as the first engaging part 331 of the block lever 33 is formed in such a way as to, in a state in which the block lever 33 is positioned at the block position, extend in a direction intersecting (almost intersecting at right angles in this example) the moving direction (a direction of the block lever 33 from the block position toward the retraction position) of the block lever 33 and in a circumferential direction of the rotary member 23 and be positioned on a rotation movement path of the fourth engaging part 234 of the rotary member 23. Accordingly, in the state in which the block lever 33 is positioned at the block position, the fourth engaging part 234 of the rotary member 23 is insertable in and removable from the first engaging part 331 (groove) of the block lever 33 at the block position by rotational movement of the rotary member 23 from the neutral position to the locking correspondent position. Then, in a state in which the fourth engaging part 234 of the rotary member 23 is engaged (fit) in the first engaging part 331 (groove) of the block lever 33, the block lever 33 is held at the block position and cannot move to the retraction position.

The block lever urging member 34 is an example of a second urging member and is configured to always elastically urge the block lever 33 toward the retraction position. A helical torsion coil spring having an arm at each of the two ends is applicable to the block lever urging member 34. Then, one arm is engaged with the block lever 33, and the other arm is engaged with the housing 21. The urging force of the block lever urging member 34 is less than the urging force of the moderating spring 35 urging the active lever 25.

The second engaging part 332 of the block lever 33 is configured to be engageable with and disengageable from the third engaging part 253 of the active lever 25. When the active lever 25 moves from the locking position to the unlocking position, the second engaging part 332 of the block lever 33 is pushed by the third engaging part 253 of the active lever 25, and the block lever 33 moves from the retraction position to the block position against the urging force of the block lever urging member 34. Then, in a state in which the active lever 25 is positioned at the unlocking position, the block lever 33 is held at the block position. When the active lever 25 moves from the unlocking position to the locking position, the engagement between the third engaging part 253 of the active lever 25 and the second engaging part 332 of the block lever 33 is disengaged.

The inside open lever 30 is rotatably supported by the fourth supporting part 214 with respect to the housing 21 and is configured to be rotatably movable between a non-operating position and an operating position. FIG. 4 to FIG. 9 illustrate states in which the inside open lever 30 is positioned at the non-operating position. The operating position of the inside open lever 30 is a position rotated from the non-operating position by a predetermined angle in a clockwise direction in FIG. 4 to FIG. 9.

The inside open lever 30 is linked with the inside door handle 126 provided on the vehicle door 12 and is configured to move from a non-operating position to an operating position in conjunction with a manual operation of the inside door handle 126. For example, the inside open lever 30 is connected to the inside door handle 126 by an unillustrated operating wire. Further, the inside open lever 30 is always elastically urged toward the non-operating position by an unillustrated urging member (such as a spring). Accordingly, in a state in which the inside door handle 126 is not operated, the inside open lever 30 is held at the non-operating position by the urging force of the urging member.

The inside open lever 30 includes an engaging part 301. The engaging part 301 of the inside open lever 30 is configured to be engageable with and disengageable from a first engaging part 291 of the inside lever 29. Then, the inside open lever 30 is configured in such a way that the engaging part 301 of the inside open lever 30 engages with the first engaging part 291 of the inside lever 29 and push the first engaging part 291 of the inside lever 29 when moving from the non-operating position to the operating position.

The inside lever 29 is rotatably supported by the third supporting part 213 with respect to the housing 21 and is rotatably movable between a non-operating position and an operating position. FIG. 4 to FIG. 9 illustrate states in which the inside lever 29 is positioned at the non-operating position. The operating position of the inside lever 29 in FIG. 4 to FIG. 9 is a position rotationally moved from the non-operating position by a predetermined angle in a counter-clockwise direction.

The inside lever 29 includes the first engaging part 291 and a second engaging part 292. The first engaging part 291 of the inside lever 29 is configured to be engageable with and disengageable from the engaging part 301 of the inside open lever 30. The second engaging part 292 of the inside lever 29 is configured to be engageable with and disengageable from an engaging part 312 of the outside open lever 31. Then, when the inside open lever 30 moves from the non-operating position to the operating position, the first engaging part 291 of the inside lever 29 is pushed by the engaging part 301 of the inside open lever 30, and the inside lever 29 moves from the non-operating position to the operating position. When the inside lever 29 moves from the non-operating position to the operating position, the second engaging part 292 of the inside lever 29 engages with the engaging part 312 of the outside open lever 31 and pushes the engaging part 312 of the outside open lever 31. Consequently, the outside open lever 31 moves from a non-operating position to an operating position.

The outside open lever 31 is rotatably supported by the fifth supporting part 215 with respect to the housing 21 and is rotatably movable between the non-operating position and the operating position. FIG. 4 to FIG. 9 illustrate states in which the outside open lever 31 is positioned at the non-operating position. The axis C5 (rotational center line) of the outside open lever 31 is in an almost horizontal direction side to side in FIG. 4 to FIG. 9.

The outside open lever 31 is linked with the outside door handle 127. For example, the outside open lever 31 is connected to the outside door handle 127 by an operating wire. Then, the outside open lever 31 is configured to rotationally move from the non-operating position to the operating position by a manual operation of the outside door handle 127 by a user. Furthermore, the outside open lever 31 includes the supporting part 311 and rotatably supports the open link 27 by the supporting part 311.

Further, the outside open lever 31 is always elastically urged by the outside open lever urging member 32 toward the non-operating position and is held to the non-operating position by the urging force of the outside open lever urging member 32 when the outside door handle 127 is not operated and when the inside lever 29 is not positioned at the operating position (that is, when the inside door handle 126 is not operated).

The latch mechanism 40 is configured to be switchable between the latched state in which the vehicle door 12 is held in the closed state and the unlatched state in which the closed state of the vehicle door 12 can be released. While a specific structure of the latch mechanism 40 is not particularly limited, and various known structures are applicable, the following structure is applicable as an example.

The latch mechanism 40 includes the latch 41, the pole (unillustrated), and the lift lever 42. The latch 41 is rotatably supported on a frame or the like of the door lock device 2 and is rotatably movable between an unlatched position and a latched position (a half latched position and a fully latched position). The unlatched position is a position where the striker 101 provided on the vehicle body 10 is not held (can be engaged or disengaged), that is, a position where the engagement between the latch 41 and the striker 101 can be released. The latched position is a position where the striker 101 provided on the vehicle body 10 is held (engaged), that is, a position where the engagement between the latch 41 and the striker 101 cannot be released, when the vehicle door 12 is in the closed state. The latch 41 is always urged by the latch return spring toward the unlatched position.

The pole is rotatably supported on the frame or the like of the door lock device 2 and is movable between an engaged position and a disengaged position. The engaged position is a position where the latch 41 is held to the latched position (rotational movement to the unlatched position is blocked) by engagement with the latch 41. The unlatched position is a position where the pole is not engaged with the latch 41 and is a position where rotational movement of the latch 41 to the unlatched position is permitted. Further, the pole is always elastically urged by the pole return spring toward the engaged position.

Then, when the vehicle door 12 is in the closed state, the latch mechanism 40 holds the engagement state between the latch 41 and the striker 101 by the latch 41 being positioned at the latched position and holds the latch 41 at the latched position by the pole being positioned at the engaged position. Consequently, the latch mechanism 40 holds the vehicle door 12 in the closed state with respect to the vehicle body 10.

When moving from the non-releasing position to the releasing position while the vehicle door 12 is in the closed state, the lift lever 42 engages with the pole and moves the pole (for example, by pushing the pole) from the engaged position to the disengaged position. Consequently, the engagement between the pole and the latch 41 is released, the latch 41 rotationally moves to the unlatched position by the urging force of the latch return spring, and the closed state of the vehicle door 12 can be released. Thus, the latch mechanism 40 is configured to switch from the latched state to the unlatched state by movement of the lift lever 42 when the lift lever 42 moves from the non-releasing position to the releasing position.

Next, an operation of the door lock device 2 will be explained.

FIG. 4 illustrates a state in which the rotary member 23 is positioned at the neutral position and the active lever 25 is positioned at the locking position. The state illustrated in FIG. 4 is referred to as a locking basic state. When in the locking basic state, the rotary member 23 is positioned at the neutral position, and the first engaging part 231 of the rotary member 23 is engaged with neither the first engaging part 251 nor the second engaging part 252 of the active lever 25. Accordingly, the active lever 25 is held at the locking position by the urging force of the moderating spring 35. Then, when the active lever 25 is positioned at the locking position, the open link 27 is urged toward the unopen position by the open link urging member 28 attached to the active lever 25, and the open link 27 is held at the unopen position.

When the outside door handle 127 is manually operated in the locking basic state illustrated in FIG. 4, the operation of the outside door handle 127 is transferred to the outside open lever 31, and the outside open lever 31 moves from the non-operating position to the operating position. Further, when the inside door handle 126 is manually operated in the locking basic state illustrated in FIG. 4, the operation of the inside door handle 126 is transferred to the outside open lever 31 through the inside open lever 30 and the inside lever 29, and the outside open lever 31 moves from the non-operating position to the operating position. However, the open link 27 is positioned at the unopen position, and therefore even when the open link 27 is actuated with movement of the outside open lever 31 from the non-operating position to the operating position, the open link 27 does not engage with a first engaging part 321 of the lift lever 42. Consequently, the lift lever 42 does not move from the non-releasing position, and the latch mechanism 40 is held in the latched state.

Thus, the open link 27 is configured not to switch the latch mechanism 40 from the latched state to the unlatched state (not to release the engagement between the latch 41 and the striker 101) even when actuated by a mechanical operation of the outside open lever 31 in a state of being positioned at the unopen position. Consequently, the vehicle door 12 cannot be opened.

When the rotary member 23 is positioned at the neutral position as illustrated in FIG. 4, the first engaging part 331 of the block lever 33 does not engage with the fourth engaging part 234 of the rotary member 23. Further, when the active lever 25 is positioned at the locking position, the block lever 33 is permitted to move to the retraction position. Accordingly, the block lever 33 is held at the retraction position by the urging force of the block lever urging member 34.

FIG. 5 is a diagram illustrating an operation of switching the door lock device 2 from the locked state to the unlocked state. In this case, the electric motor 22 in the door lock device 2 in the locking basic state is energized, and the electric motor 22 is rotated in one direction (such as a forward direction). Consequently, the rotary member 23 rotationally moves from the neutral position illustrated in FIG. 4 to the unlocking correspondent position. FIG. 5 illustrates a state in which the rotary member 23 rotates to the unlocking correspondent position. When the active lever 25 is positioned at the locking position as illustrated in FIG. 4, the first engaging part 251 of the active lever 25 is positioned on the rotation path of the first engaging part 231 of the rotary member 23. Accordingly, when the electric motor 22 operates and the rotary member 23 rotationally moves from the neutral position to the unlocking correspondent position as illustrated in FIG. 5 (when the rotary member 23 rotates from the neutral position in a counter-clockwise direction in the examples illustrated in FIG. 4 and FIG. 5), the first engaging part 231 of the rotary member 23 engages with the first engaging part 251 of the active lever 25 and pushes the first engaging part 251. Consequently, the active lever 25 rotationally moves from the locking position to the unlocking position. Then, when rotationally moving a predetermined distance from the locking position toward the unlocking position, the active lever 25 moves to the unlocking position by the urging force of the moderating spring 35 and is positioned at the unlocking position by coming in contact with a stopper or the like at the unlocking position. Consequently, the door lock device 2 is switched from the locked state to the unlocked state. Thus, the door lock device 2 is switched from the locked state to the unlocked state by rotational movement of the rotary member 23 from the neutral position to the unlocking correspondent position.

When the active lever 25 moves from the locking position to the unlocking position, the operation of the active lever 25 is transferred to the open link 27 through the open link urging member 28, and the open link 27 moves from the unopen position to the open position. Further, the second engaging part 332 of the block lever 33 is pushed toward the block position by the third engaging part 253 of the active lever 25. Consequently, the block lever 33 moves from the retraction position to the block position against the urging force of the block lever urging member 34.

FIG. 6 illustrates a state in which the operation of the electric motor 22 is stopped after the state illustrated in FIG. 5 is entered (a state in which energization of the electric motor 22 is stopped). When drive of the electric motor 22 is stopped, the rotary member 23 moves to the neutral position by the urging force of the rotary member urging member 24. However, the first engaging part 231 of the rotary member 23 does not engage with the first engaging part 251 of the active lever 25 even when the rotary member 23 moves to the neutral position, and therefore the active lever 25 is held at the unlocking position by the urging force of the moderating spring 35. Then, by the active lever 25 being held at the unlocking position, the block lever 33 is held at the block position.

In the state illustrated in FIG. 6, the active lever 25 is positioned at the unlocking position, and the rotary member 23 is positioned at the neutral position. The state is referred to as an unlocking basic state. When the outside door handle 127 or the inside door handle 126 is manually operated in the door lock device 2 in the unlocking basic state, the outside open lever 31 moves from the non-operating position to the operating position. At this time, the open link 27 is positioned at the open position, and therefore the open link 27 moves from the non-operating position to the operating position along with the outside open lever 31 and pushes the first engaging part 421 of the lift lever 42. Consequently, the lift lever 42 moves from the non-releasing position to the releasing position, and the latch mechanism 40 is switched from the latched state to the unlatched state.

Thus, the open link 27 is configured to switch the latch mechanism 40 from the latched state to the unlatched state (release the engagement between the latch 41 and the striker 101) when being actuated by a mechanical operation of the outside open lever 31 in a state of being positioned at the open position. Consequently, the door lock device 2 is switched from the locked state to the unlatched state, and the vehicle door 12 can be opened.

FIG. 7 is a diagram illustrating an operation of switching the door lock device 2 from the unlocked state to the locked state. In this case, the electric motor 22 in the door lock device 2 in the unlocking basic state is energized, and the electric motor is caused to rotate in another direction (such as a reverse direction). Consequently, the rotary member 23 rotates from the neutral position illustrated in FIG. 6 toward the locking correspondent position. FIG. 7 illustrates a state in which the rotary member 23 rotates by a predetermined amount from the neutral position to the locking correspondent position. When the rotary member 23 rotates by the predetermined amount from the neutral position toward the locking correspondent position by the rotational driving force of the electric motor 22, the fourth engaging part 234 of the rotary member 23 engages with the first engaging part 331 of the block lever 33 before the first engaging part 231 of the rotary member 23 engages with the second engaging part 252 of the active lever 25, as illustrated in FIG. 7. When the fourth engaging part 234 of the rotary member 23 engages with the first engaging part 331 of the block lever 33, the block lever 33 enters a state of not being able to move from the block position to the retraction position.

FIG. 8 is a diagram illustrating a state in which the rotary member 23 further rotates from the position illustrated in FIG. 7 and reaches the locking correspondent position. When the rotary member 23 reaches the locking correspondent position, the first engaging part 231 of the rotary member 23 pushes the second engaging part 252 of the active lever 25, and the active lever 25 moves from the unlocking position toward the locking position. Then, the active lever 25 moves a predetermined distance from the unlocking position by being pushed by the first engaging part 231 of the rotary member 23, subsequently moves to the locking position by the urging force of the moderating spring 35, and is positioned at the locking position by coming in contact with a stopper or the like. Consequently, the door lock device 2 is switched from the unlocked state to the locked state. Thus, when the door lock device 2 is switched from the unlocked state to the locked state, the active lever 25 rotates from the unlocking position to the locking position after the rotary member 23 engages with the block lever 33 at the block position (specifically, after the fourth engaging part 234 of the rotary member 23 starts engaging with the first engaging part 331 of the block lever 33).

When the active lever 25 moves from the unlocking position to the locking position, the engagement between the third engaging part 253 of the active lever 25 and the second engaging part 332 of the block lever 33 is disengaged, and therefore the block lever 33 is going to move from the block position to the retraction position by the urging force of the block lever urging member 34. However, when the active lever 25 moves from the unlocking position to the locking position, the first engaging part 331 of the block lever 33 is already engaged with the fourth engaging part 234 of the rotary member 23. The fourth engaging part 234 (wall-shaped projection) of the rotary member 23 is engaged with (inserted in) the first engaging part 331 (groove) of the block lever 33 from a direction intersecting the moving direction of the block lever 33, and therefore the block lever 33 cannot get out of the block position by such engagement and is held at the block position.

Subsequently, energization of the electric motor 22 is stopped. In this case, rotation of the rotary member 23 may continue by inertia even after energization of the electric motor 22 is stopped. Consequently, the rotary member 23 is going to move toward the releasing position past the locking correspondent position by inertia after energization of the electric motor 22 is stopped. However, in the present embodiment, the block lever 33 is positioned at the block position, and therefore the rotary member 23 comes in contact with the block lever 33 at the locking correspondent position and movement thereof is blocked. Specifically, the third engaging part 233 of the rotary member 23 comes in contact with a side wall 333 constituting one side of the block lever 33 at the locking correspondent position. Consequently, the block lever 33 blocks the rotary member 23 from overshooting the locking correspondent position (that is, moving more toward the releasing position side than the locking correspondent position).

After the inertia of the rotary member 23 as described above disappears, the rotary member 23 moves to the neutral position by the urging force of the rotary member urging member 24. When the rotary member 23 moves to the neutral position, the engagement between the fourth engaging part 234 of the rotary member 23 and the first engaging part 331 of the block lever 33 is released (the fourth engaging part 234 of the rotary member 23 gets out of the groove being the first engaging part 331 of the block lever 33). Consequently, the block lever 33 becomes movable in a direction toward the retraction position and moves from the block position to the retraction position by the urging force of the block lever urging member 34, and the door lock device 2 enters the locking basic state illustrated in FIG. 4.

Next, an operation of opening the vehicle door 12 by the driving force of the electric motor 22, that is, an electrical operation will be explained. In this case, when the door lock device 2 is in the locking basic state illustrated in FIG. 4, for example, an opening switch provided on the vehicle door 12 undergoes a pressing operation. Consequently, the electric motor 22 is energized, and the electric motor 22 rotates in another direction (such as a reverse direction). By rotation of the electric motor 22, the rotary member 23 rotationally moves from the neutral position to the releasing position past the locking correspondent position. The block lever 33 is positioned at the retraction position in the locking basic state illustrated in FIG. 4, and therefore the rotation of the rotary member 23 is not blocked by the block lever 33.

When the rotary member 23 moves from the neutral position to the releasing position by the driving force of the electric motor 22, the second engaging part 232 of the rotary member 23 engages with the first engaging part 261 of the release lever 26 and pushes the first engaging part 261 of the release lever 26. Consequently, the release lever 26 moves from the initial position to the operating position. When the release lever 26 moves to the operating position, the second engaging part 262 of the release lever 26 pushes a second engaging part 322 of the lift lever 42, and the lift lever 42 moves from the non-releasing position to the releasing position. Consequently, the latch mechanism 40 is switched from the latched state to the unlatched state. Consequently, the vehicle door 12 can be opened by the electrical operation.

The second engaging part 262 of the release lever 26 directly engages with the second engaging part 322 of the lift lever 42 of the latch mechanism 40 and moves the lift lever 42 from the non-releasing position to the releasing position. Accordingly, whether the open link 27 is at the open position or not, the latch mechanism 40 can be switched from the latched state to the unlatched state by moving the rotary member 23 from the neutral position to the releasing position. In other words, the vehicle door 12 can be opened by an electrical operation without actuating the open link 27. Subsequently, energization of the electric motor 22 is stopped. Consequently, the rotary member 23 moves to the neutral position by the urging force of the rotary member urging member 24. When the rotary member 23 returns to the neutral position, the release lever 26 returns to the initial position, and the door lock device 2 enters the locking basic state illustrated in FIG. 4.

Thus, the present embodiment enables rotational movement of the rotary member 23 to the unlocking correspondent position (first rotation position), the releasing position (second rotation position), and the locking correspondent position (third rotation position) by switching between forward and reverse directions of rotation of the electric motor 22. Accordingly, switching between the three states being the unlocked state, the locked state, and the unlatched state is enabled by switching between forward and reverse directions of rotation of the electric motor 22.

Further, in the door lock device 2 according to the present embodiment, the block lever 33 blocks the rotary member 23 from overshooting the locking correspondent position and moving to the releasing position when switching from the unlocked state to the locked state is made. Consequently, the rotary member 33 excessively rotating and reaching the releasing position when the door lock device 2 is switched from the unlocked state to the locked state and the latch mechanism 40 being switched to the unlatched state are blocked. Thus, the door lock device 2 according to the present embodiment enables accurate switching between the three states.

While the embodiment of this disclosure has been explained above, this disclosure is not limited to the embodiment. For example, the door lock device 2 according to this disclosure may be configured to normally open the vehicle door 12 by actuating the release lever 26 by an electrical operation and in case of emergency, switch to the unlocked state and open the vehicle door 12 by a mechanical operation. Further, an example of operating the outside door handle 127 or the inside door handle 126 attached to the vehicle door 12 when opening the vehicle door 12 by a mechanical operation has been explained in the aforementioned embodiment, the vehicle door 12 may be configured to be opened by a mechanical operation by use of, for example, an external tool instead of the handles. Various changes and modifications that may be made to this disclosure within the spirit thereof are also included in the technical scope of this disclosure.

A vehicular door lock device according to this disclosure includes a mechanical opening mechanism (open link), an electric motor, a rotary member, a first urging member (rotary member urging member), an active lever, a release lever, a block lever, and a second urging member (block lever urging member). The mechanical opening mechanism (open link) is configured to be rotatable between an open position and an unopen position, make a vehicle door openably and closably connected to a vehicle body openable when being actuated by a mechanical operation at the open position, and make the vehicle door unopenable when being actuated by a mechanical operation at the unopen position. The electric motor rotates in forward and reverse directions by being energized. The rotary member rotates between a first rotation position (unlocking correspondent position) and a second rotation position (unlatching correspondent position) by transfer of rotation of the electric motor. The first urging member (rotary member urging member) elastically urges the rotary member to a neutral position between the first rotation position (unlocking correspondent position) and the second rotation position (unlatching correspondent position). The active lever is rotatable between an unlocking position and a locking position, and is connected to the mechanical opening mechanism (open link) in such a way as to cause the mechanical opening mechanism (open link) to rotate from the unopen position to the open position when rotating from the locking position to the unlocking position and cause the mechanical opening mechanism (open link) to rotate from the open position to the unopen position when rotating from the unlocking position to the locking position. The release lever is configured to be rotatable between an initial position and an operating position and is configured to, by rotating from the initial position to the operating position, allow the vehicle door to open without actuation of the mechanical opening mechanism (open link). The block lever is configured to be movable between a retraction position out of a rotation path of the rotary member and a block position in a rotation path of the rotary member. The second urging member (block lever urging member) elastically urges the block lever in a direction toward the retraction position. The active lever engages with the rotary member in such a way as to rotate in a direction from the locking position toward the unlocking position when the rotary member rotates from the neutral position to the first rotation position (unlocking correspondent position) while the active lever is at the locking position and rotate in a direction from the unlocking position to the locking position when the rotary member rotates from the neutral position to a third rotation position (locking correspondent position) between the neutral position and the second rotation position (unlatching correspondent position) while the active lever is at the unlocking position. The release lever engages with the rotary member in such a way as to rotate from the initial position to the operating position at the second rotation position (unlatching correspondent position) when the rotary member rotates from the neutral position to the second rotation position (unlatching correspondent position). The block lever engages with the active lever in such a way as to move from the retraction position to the block position against an elastic urging force of the second urging member (block lever urging member) when the active lever rotates from the locking position to the unlocking position. The rotary member is configured in such a way as to cause rotation in a direction from the third rotation position (locking correspondent position) toward the second rotation position (unlatching correspondent position) to be blocked by engaging with the block lever at the third rotation position (locking correspondent position) when rotating in a direction from the neutral position toward the third rotation position (locking correspondent position) while the active lever is at the unlocking position.

With the disclosure being thus configured, when the vehicular door lock device is switched from an unlocked state (a state in which the active lever is at the unlocking position) to a locked state (a state in which the active lever is at the locking position), the electric motor is energized, and the rotary member rotationally moves from the neutral position and rotates to the third rotation position (locking correspondent position). When the rotary member reaches the third rotation position (locking correspondent position), the rotary member comes in contact with the block lever at the block position, at the third rotation position (locking correspondent position), and cannot rotate toward the second rotation position (unlatching correspondent position) side any more. Consequently, the rotary member can be stopped at the third rotation position (locking correspondent position). Further, when the rotary member reaches the third rotation position (locking correspondent position), the active lever rotates from the unlocking position to the locking position. Consequently, the vehicular door lock device can be switched to the locked state. When energization of the electric motor is subsequently stopped, the rotary member is returned to the neutral position by an elastic urging force of the first urging member. At this time, the block lever moves to the retraction position by an elastic urging force of the second urging member due to release of the engagement with the active lever.

Further, when the vehicular door lock device is switched to an unlatched state, the electric motor is energized, and the rotary member rotates from the neutral position to the second rotation position (unlatching correspondent position). When the vehicular door lock device is in the locked state and the rotary member is at the neutral position, the block lever is positioned at the retraction position. Accordingly, the rotary member can rotationally move from the neutral position to the second rotation position (unlatching correspondent position) past the third rotation position (locking correspondent position) without the block lever blocking the path. Consequently, the vehicle door can be opened by an electrical operation (by rotational power of the electric motor) by rotating the release lever from the initial position to the operating position. When energization of the electric motor is subsequently stopped, the rotary member is returned to the neutral position by the elastic urging force of the first urging member.

Further, when the vehicular door lock device is switched from the locked state to the unlocked state, the electric motor is energized, and the rotary member rotationally moves from the neutral position to the first rotation position (unlocking correspondent position) on the opposite side of the second rotation position (unlatching correspondent position) and the third rotation position (locking correspondent position). When the rotary member reaches the first rotation position (locking correspondent position), the active lever rotates from the locking position to the unlocking position. Consequently, the vehicular door lock device can be switched to the unlocked state. When energization of the electric motor is subsequently stopped, the rotary member is returned to the neutral position by the elastic urging force of the first urging member. Thus, this disclosure enables switching between the three states by switching between forward and reverse directions of rotation of the electric motor.

Then, according to this disclosure, when switching from the unlocked state to the locked state is made, the rotary member overshooting the third rotation position (locking correspondent position) and reaching the second rotation position (unlatched position) is blocked by engagement of the rotary member with the block lever at the third rotation position (locking correspondent position). Consequently, switching of the latch mechanism to the unlatched state is blocked when switching is made from the unlocked state to the locked state. Accordingly, this disclosure enables suitable switching between the three states (the locked state, the unlocked state, and the unlatched state).

The mechanical opening mechanism (open link) according to this disclosure may be configured to open the vehicle door by releasing engagement between a latch provided on the vehicle door openably and closably connected to the vehicle body and a striker fixed to the vehicle body when being actuated by a mechanical operation at the open position and not to open the vehicle door by not releasing the engagement between the latch and the striker when being actuated by a mechanical operation at the unopen position. Further, the release lever may be configured to be rotatable between the initial position and the operating position and may be configured to be able to, by rotating from the initial position to the operating position, release the engagement between the latch and the striker without actuation of the mechanical opening mechanism (open link).

In the vehicular door lock device according to this disclosure, when the rotary member rotates from the neutral position to the third rotation position while the active lever is at the unlocking position, the active lever may rotate to the locking position, and the block lever may be held at the block position by engagement with the rotary member.

In this case, the active lever may be configured to rotate from the unlocking position to the locking position after the rotary member engages with the block lever at the block position when the rotary member rotates from the neutral position to the third rotation position (locking correspondent position) while the active lever is at the unlocking position.

With the disclosure being thus configured, the rotary member engages with the block lever at the third rotation position (locking correspondent position), and with the block lever being held at the block position by the engagement power, the active lever rotates from the unlocking position to the locking position. Accordingly, the engagement between the rotary member and the block lever is maintained even after the active lever rotates to the locking position, and therefore the rotary member can be precisely stopped at the third rotation position (locking correspondent position).

In the vehicular door lock device according to this disclosure, the rotary member may include an engaging part (fourth engaging part) engageable with the block lever, and the engaging part (fourth engaging part) may engage with the block lever at the third rotation position (locking correspondent position) from a direction intersecting a moving direction of the block lever when the rotary member rotates from the neutral position to the third rotation position (locking correspondent position) while the active lever is at the unlocking position.

In this case, the engaging part (fourth engaging part) may be a wall-shaped projection extending in a circumferential direction of the rotary member and the block lever may include a first engaging part as a groove which the aforementioned projection is inserted in and removed from.

With the disclosure being thus configured, the rotary member is engaged with the block lever at the third rotation position (locking correspondent position) from the direction intersecting the moving direction of the block lever, and therefore the block lever cannot move from the block position to the retraction position. Accordingly, even when the active lever subsequently rotates from the unlocking position to the locking position, the engagement between the rotary member and the block lever is maintained, and the rotary member can be precisely stopped at the third rotation position (locking correspondent position). Then, when energization of the electric motor is subsequently stopped, and the rotary member is returned to the neutral position by the elastic urging force of the first urging member, the engagement between the rotary member and the block lever is released, and the block lever moves to the retraction position by the elastic urging force of the second urging member.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicular door lock device comprising:

a mechanical opening mechanism configured to be rotatable between an open position and an unopen position, make a vehicle door openably and closably connected to a vehicle body openable when being actuated by a mechanical operation at the open position, and make the vehicle door unopenable when being actuated by a mechanical operation at the unopen position;

an electric motor rotating in forward and reverse directions by being energized;

a rotary member rotating between a first rotation position and a second rotation position by transfer of rotation of the electric motor;

a first urging member elastically urging the rotary member to a neutral position between the first rotation position and the second rotation position;

an active lever being rotatable between an unlocking position and a locking position and being connected to the mechanical opening mechanism in such a way as to cause the mechanical opening mechanism to rotate from the unopen position to the open position when rotating from the locking position to the unlocking position and cause the mechanical opening mechanism to rotate from the open position to the unopen position when rotating from the unlocking position to the locking position;

a release lever being configured to be rotatable between an initial position and an operating position and being configured to, by rotating from the initial position to the operating position, allow the vehicle door to open without actuation of the mechanical opening mechanism;

a block lever configured to be movable between a retraction position out of a rotation path of the rotary member and a block position in a rotation path of the rotary member; and a second urging member elastically urging the block lever in a direction toward the retraction position, wherein the active lever engages with the rotary member in such a way as to rotate in a direction from the locking position toward the unlocking position when the rotary member rotates from the neutral position to the first rotation position while the active lever is at the locking position and rotate in a direction from the unlocking position to the locking position when the rotary member rotates from the neutral position to a third rotation position between the neutral position and the second rotation position while the active lever is at the unlocking position, the release lever engages with the rotary member in such a way as to rotate from the initial position to the operating position at the second rotation position when the rotary member rotates from the neutral position to the second rotation position, the block lever engages with the active lever in such a way as to move from the retraction position to the block position against an elastic urging force of the second urging member when the active lever rotates from the locking position to the unlocking position, and the rotary member is configured in such a way as to cause rotation in a direction from the third rotation position toward the second rotation position to be blocked by engaging with the block lever at the third rotation position when rotating in a direction from the neutral position toward the third rotation position while the active lever is at the unlocking position.

2. The vehicular door lock device according to claim 1, wherein, when the rotary member rotates from the neutral position to the third rotation position while the active lever is at the unlocking position, the active lever rotates to the locking position, and the block lever is held at the block position by engagement with the rotary member.

3. The vehicular door lock device according to claim 2, wherein the rotary member includes an engaging part engageable with the block lever, and the engaging part engages with the block lever at the third rotation position from a direction intersecting a moving direction of the block lever when the rotary member rotates from the neutral position to the third rotation position while the active lever is at the unlocking position.

* * * * *